United States Patent [19]

Sbaschnigg et al.

[11] Patent Number: 4,913,358

[45] Date of Patent: Apr. 3, 1990

[54] MIXER FOR PULP AND BLEACHING CHEMICALS

[75] Inventors: Johann Sbaschnigg; Richard Baumgarter; Wilhelm Mausser, all of Graz, Austria

[73] Assignee: Maschinenfabrik Andritz Actiegesellshaft, Grax, Austria

[21] Appl. No.: 203,907

[22] Filed: Jun. 8, 1988

[30] Foreign Application Priority Data

Jun. 12, 1987 [AT] Austria ..... 1499/87

[51] Int. Cl.[4] ..... C02C 7/14

[52] U.S. Cl. ..... 241/32; 241/259.2; 241/261.2

[58] Field of Search ..... 241/32, 37, 261.2, 261.3, 241/257 R, 259, 259.1, 259.2, 259.3

[56] References Cited

U.S. PATENT DOCUMENTS

| | | | |
|---|---|---|---|
| 2,059,249 | 11/1936 | Kopf | 241/259.1 X |
| 2,440,171 | 4/1948 | Eldridge | 241/32 |
| 3,923,255 | 12/1975 | Leonard | 241/259.2 X |
| 4,109,873 | 8/1978 | Lichfield | 241/259.1 X |
| 4,416,548 | 11/1983 | Carre . | |

FOREIGN PATENT DOCUMENTS

| | | | |
|---|---|---|---|
| 1296936 | 6/1969 | Fed. Rep. of Germany | 241/259.2 |

*Primary Examiner*—Mark Rosenbaum
*Attorney, Agent, or Firm*—Paul & Paul

[57] ABSTRACT

A high-output mixer, for the refining of intitially comminuted material and mixing with bleaching chemicals before introducing these in a bleaching tower, includes a horizonatal, ring-shaped mixing/refining zone betwwen a rotor disk as a lower part and a removable stator unit as an upper part.

6 Claims, 1 Drawing Sheet

MIXER FOR PULP AND BLEACHING CHEMICALS

Figure 2:
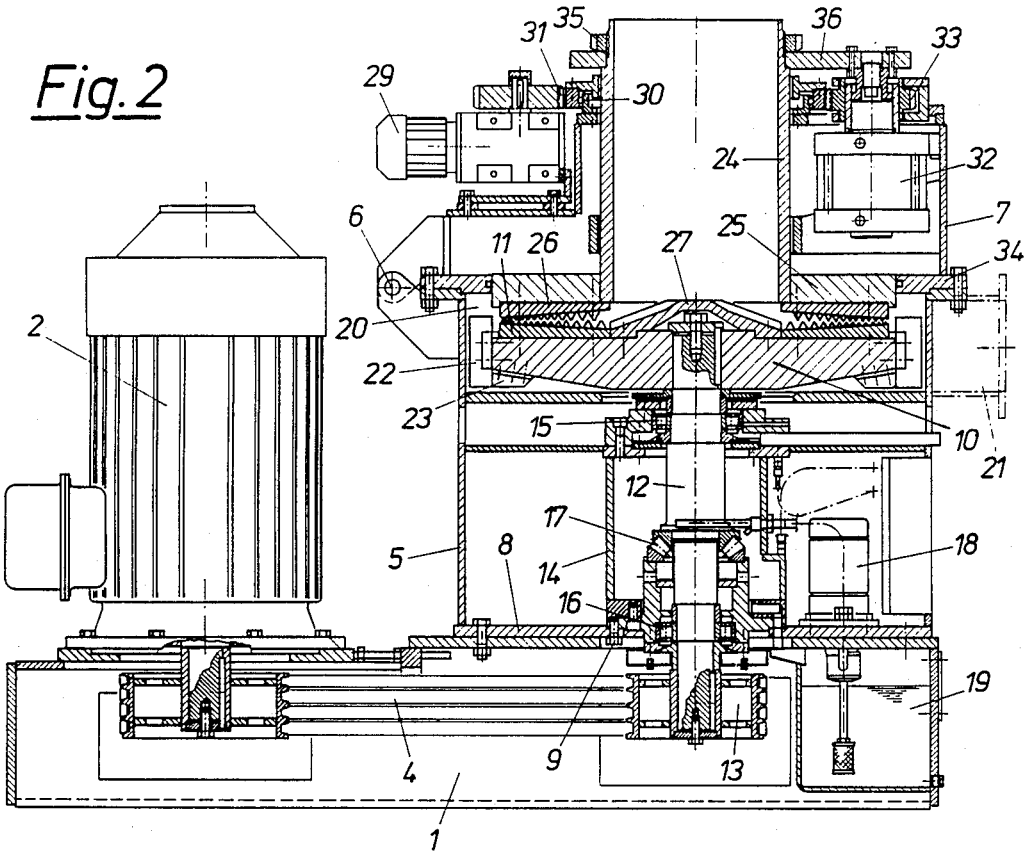

The invention concerns a mixer with a horizontal, ring-shaped mixing/refining zone, which is constructed between a disk rotor, as a lower part, and a removable—in fact, collapsible—stator unit, and an upper part.

In particular, this mixer is designed to be a heavy duty mixer for the refining of comminuted materials and for mixing with bleaching chemicals before putting them in a bleaching tower, especially for a peroxide bleach.

A mixer for this purpose, for which material density from about 20 to 55% (preferably from 23 to 50%) is the goal, should fulfill the following tasks:

- efficient mixing—in of the bleaching chemicals
- reduced consumption of chemicals
- no structural alteration of the fibers before and after mixing-in
- pressure-controlled unraveling/mixing zone
- symmetrical penetration of the bleaching chemicals through the highest material density and very low energy use and, as a result, optimal use of high-consistency bleach
- conservation of bleaching chemicals through the increase of material density in the bleaching process.

These tasks are carried out by a mixer according to this invention if an adjustable grinding aperture is provided in a mechanical adjustment system; by which, if necessary, the stationary part can be lifted off of the disk rotor to prevent jamming of the installation within a pneumatic high-speed ventilation system.

Moreover, the invention can show the following characteristics, which can be joined with each other in any combination:

The stator unit can be constructed with a central material and chemical entry tube, and the mixing/refining zone can form an aperture with a cross-section that decreases radially outwardly, in particular, a wedge-shaped aperture.

The configuration of the aperture can be designed to be adjustable; in particular, the entry pipe can be connected to the periphery of the aperture on the stator side and be designed to be movable within the stator opposite the disk rotor along the rotor axis.

A mechanical actuating drive for shifting the entry pipe in the stator can be provided. The mechanical drive can operate lifting and lowering devices arranged at the same distance from each other around the entry pipe. The lifting and lowering devices can be supported on one side at the stator and on the other at the entry pipe. The mechanical actuating device preferably includes a pinion drive over a toothed ring, the toothed ring being supported over a spherical cap bearing opposite the stator surrounding the entry pipe.

An overload control, preferably a pneumatic one, can be provided. The overload control permits an enlargement of the aperture should a higher axial force appear, especially by shifting the entry pipe in the stator.

The overload control can be provided with a breakdown safety device, preferably a clamp safety device, which prevents enlargement of the aperture should the overload control fail; in particular the safety device can lock a component connected with the entry pipe against axial shifting.

The disk rotor runs in a cylinder space with radial delivery, by which the products in the mixture are moved radially outwards through the aperture into an annular space, in which conveyor wings arranged on the rotor circulate.

The disk rotor is equipped with a cap on the side of the entry pipe with an input and distribution zone. Preferably, the cap is frustum-shaped, with conveyor supports, which feed the products to be mixed in the aperture.

The disk rotor and its shaft are constructed as a separable component to permit raising the stator, releasing the means of attachment and uncoupling of the drive from the bottom part of the mixer.

It is an advantage that the metered addition of the bleaching chemicals occurs directly before the introduction of material into the mixer. For example, the starting material (such as mechanical wood pulp, TMP or CTMP is initially dessicated over a belt press, generally a double wire press, is comminuted in a fine unraveler and then is stretched over a feed screw for the mixing intake, in which the addition of bleaching chemicals occurs before the introduction of material into the mixer. After passing through the mixer, the material reaches a bleaching tower and is carried away from there as bleached material.

With the mixer corresponding to this invention, the initially unraveled length of material is further pulled apart into individual fibers. The bleaching agent solution penetrates past the large fiber surface quickly and symmetrically into the fibers themselves. The mixing process does not create a change in the pulp fiber.

The bleaching process is more effective with higher material density when a higher chemical concentration is used. This means that there is considerable economizing on bleaching chemicals and a higher paper brightness.

The costs saved with the mixer in this invention in connection with the high consistency bleach should amount to 20%, compared to the usual process.

A steam-controlled unraveling/mixing zone in particular is achieved through the adjustability of the mixing aperture, so that no change in the fibers develops. The overload control in the invention is also quite essential for this puepose, providing quick release of the mixing disk in case of excessive axial pressure buildup.

A design aspect of the mixer in this invention especially amenable to maintenance is given if the disk rotor is constructed, together with the unraveling disk set onto it, the rotor shaft, and its driving flange (for example, a pulley), to be removable as a unit from its mounting, as by means of holding-down bolts.

The invention is more closely described, with reference to the illustrations, with the help of the most preferred examples of implementation presently available of a high-consistency mixer for material bleaching in cellulose reprocessing.

Figure 1:
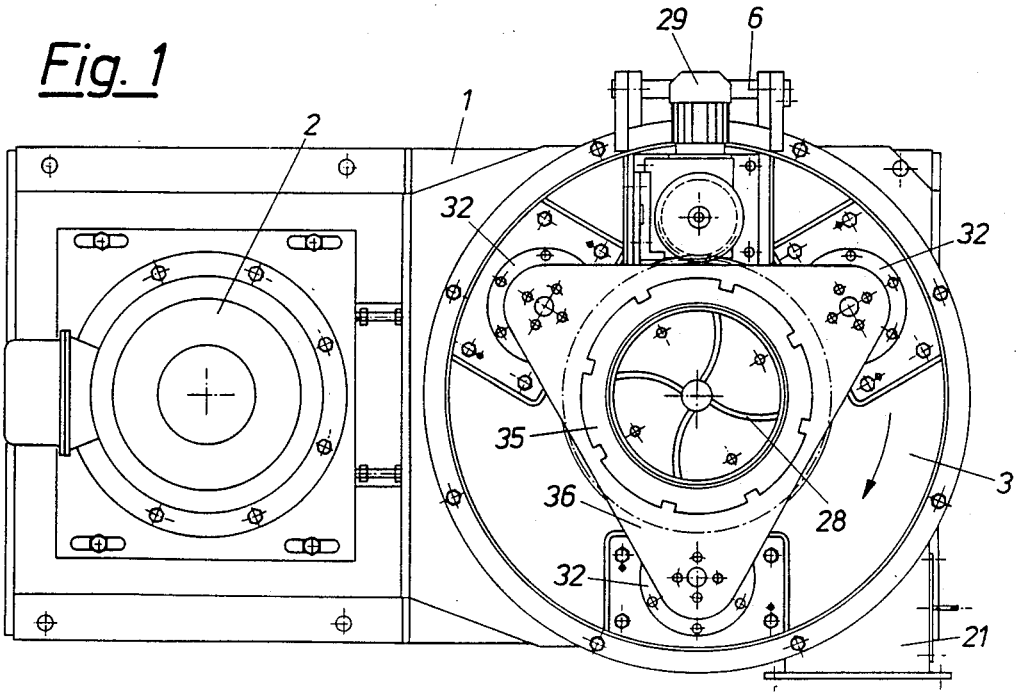

In FIG. 1 a top view of this mixer is shown, and in FIG. 2 a corresponding, partly cut away side view is shown, in which the mixer unit is presented turned at a ninety degree angle for the sake of clarity.

On a case foundation (1) the drive motor (2) and a mixer unit (3) are arranged side by side and are connected to each other by means of a multiple belt drive. The mixer unit (3) comprises an underside housing or casing (5) screwed together with the case foundation (1) and an upperside housing (7) screwed together with the underside housing (5) and hinged with the axle (6) opposite this underside housing.

On the bottom wall (8) of the underside housing (5) a component is screwed into the unit at (9), which can be lifted when the upper housing is opened and the drive belt (4) is removed after the releasing of the oil ducts and the fastening screws (9) upwards from the underside housing (5), and consists of the following individual parts: disk rotor (10) with mixing disk (11) set onto it, rotor drive shaft (12) with pulley (13) and bearing case (14) arranged between disk rotor (10) and pulley (13), in which an upper radial bearing (15) and a lower radial bearing (16) for guiding the rotor shaft (12), and between them an angular roller bearings (17) for the reception of axial forces active in the direction of foundation (1). the bearings (15) through (17) are lubricated in the usual way by being circulated. In FIG. 2 the oil pump (18) and the oil tank (19) are to be distinguished as well the oil connecting flanges on the left next to the oil pump; these flanges are not indicated in close detail.

The disk rotor (10) operates in a cylindrical space (20<which is closed upwards by the surface of the upperside housing (7) when it is closed and shows a side opening (21) for the discharge of the material processed in the mixer. To move this material to side opening (21), disk rotor (10) is equipped with radial conveyor wings (22) and with conveyor wings pointed downward (23) which move along the side wall and on the bottom of the cylindrical space. In the upperside housing (7) a material entry pipe (24) is arranged so that disk rotor axis and entry pipe axis are aligned when the upperside housing is closed. The diameter of the entry pipe (24) is about the same as the inner diameter of mixing disk (11), which is arranged on the disk rotor (10). The entry pipe (24) forms a component with a cylindrical bottom plate (25), on whose underside an opposing mixing disk (26) is fastened so that when the upperside housing (7) is closed, a mixing aperture is formed between mixing disk (11) and opposing mixing disk (26). The mixing aperture becomes narrower radially outwardly. The disks (11) and (26) have corresponding toothing. The disk rotor (10) has a nozzle ring (27) with curved feeder ribs (28) on the entry pipe side, which feed material moved through the entry pipe from top to bottom into the mixer aperture.

The component consisting of entry pipe (24)/bottom plate (25)/opposing mixing disk (26) is designed to be shiftable in the upperside housing (7), so that the configuration of the mixer aperture is adjustable. A gear motor (29) is flange-mounted on the upperside housing (7) for this purpose; the gear motor's pinion operates a toothed ring or crown gear (31) supported on the upperside housing (7) over a spherical ring bearing (30); the toothed ring rotatably surrounds the entry pipe (24).

Three variable-length adjustment instruments (32) with parallel axes are arranged at the same distance from each other around the entry pipe (24). The adjustment instruments have respective adjustment pinions, which mesh with the toothed ring (31). The toothed ring (31) is supported on one side on the upperside casing (7) (bottom ring 34), and on the other side by means of a supporting ring (35) fastened onto the entry pipe (24). The supporting ring (35) is carried by an essentially triangular opposing plate (36). Thus, the adjustment instruments work between the upperside casing and the entry pipe. An extension of the adjustment instruments (32) guided by the gear motor (29) when the mixer is closed (upperside housing (7) screwed into·lower housing (5) ) causes an enlargement of the mixer aperture and a shortening causes a corresponding reduction. The adjustment pinion can possess an inner thread, which meshes with a trapezoidal thread, and is located above on the cylinder (32) constructed as a pneumatic cylinder.

The adjustment instruments (32) produce an overload control to the effect that, when there is an arrangement of an unacceptable axial pressure in the mixer aperture, the component consisting of opposing mixing disk (26)/bottom plate (25)/entry pipe (24) opposite the mixing disk (11) is lifted up. This is something that occurs automatically over a pressure-limiting valve on account of the short operating time, but can also occur hydraulically or mechanically.

The adjustment instruments (32) also include a mechanical break down safety device not represented here, which prevents an automatic elevation of the opposing mixing disk (26) in the case of a breakdown of the pressure-limiting valve.

We claim:

1. In a mixer for the refining of initially comminuted material and mixing with bleach chemicals for introducing mixed comminuted material and bleached chemicals into a bleaching tower, the mixer including a horizontal, ring-shaped mixing/refining aperture formed between a disk rotor as a lower part and a removable stator unit as an upper part, the improvement comprising:

the stator unit including a movable portion confronting the mixing aperture, the movable portion being adjustable to rapidly increase the vertical height of the mixing aperture responsive to oversize objects in the comminuted material, the movable portion including a central entry pipe for feeding comminuted material and chemicals into the mixer, the mixing aperture having a cross section which decreases radially outwardly, the central entry pipe discharging into the mixing aperture, the central entry pipe having a common axis with the disk rotor;

the stator unit further including a mechanical adjustment system including a high speed pneumatic system for rapidly raising the movable portion of the stator unit, the mechanical adjustment system including a mechanical adjustment drive for shifting the movable part including the entry pipe within the stator unit, the adjustment drive including a plurality of mechanical lifting and lowering devices and a pinion drive engaging a crown gear supported over a spherical cap bearing, the crown gear surrounding the central entry pipe, the crown gear driving the mechanical lifting and lowering devices, the lifting and lowering devices being arranged at the same distance from one another around the entry pipe, the lifting and lowering devices driving the axial movement of the movable portion of the stator unit.

2. A mixer according to claim 1 further including an overload control, the overload control permitting an enlargement of the mixing aperture responsive to increased axial force, the overload control being provided with a breakdown safety device, the safety device preventing enlargement of the aperture should the overload control fail.

3. A mixer according to claim 1 further including an overload control, the overload control permitting an enlargement of themixing aperture responsive to increased axial force.

4. A mixer according to claim 1 wherein the mixer includes an underside housing the disk rotor rotating in a cylindrical space formed within the underside housing with radial delivery, the rotor including a body and radial conveyer wings circulating in an annular space between the rotor body and the underside housing, whereby the material being mixed is moved radially outwardly through the aperture to the annular space.

5. A mixer according to claim 1 wherein the disk rotor includes a cap confronting the entry pipe, the cap including a nozzle ring with curved feeder bars for feeding products to be mixed into the mixing aperture from the entry pipe.

6. A mixer according to claim 1 wherein the disk rotor rotates on a rotor shaft, the disk rotor and rotor shaft comprising a separable component.

* * * * *

UNITED STATES PATENT AND TRADEMARK OFFICE

CERTIFICATE OF CORRECTION

PATENT NO. : 4,913,358

DATED : April 3, 1990

INVENTOR(S) : Johann Sbaschnigg, Richard Baumgarter and Wilhelm Mausser

It is certified that error appears in the above-identified patent and that said Letters Patent is hereby corrected as shown below:

Column 1, line 54, delete "device", and substitute -- drive --.
Column 2, line 45, delete "puepose", and substitute -- purpose --.
Column 3, line 16, delete "the", and substitute -- The --.
Column 3, line 22, delete " < ", and substitute -- ) --.

Signed and Sealed this

Twentieth Day of August, 1991

*Attest:*

HARRY F. MANBECK, JR.

*Attesting Officer*

*Commissioner of Patents and Trademarks*